United States Patent [19]

Nelson

[11] Patent Number: 4,978,001

[45] Date of Patent: Dec. 18, 1990

[54] JEWELRY CLOSET

[76] Inventor: Elsie C. Nelson, 16006 State Hwy. 42, Two Rivers, Wis. 54241

[21] Appl. No.: 439,143

[22] Filed: Nov. 20, 1989

[51] Int. Cl.[5] ..... B65D 25/10; B65D 5/52; A47B 46/00

[52] U.S. Cl. ..... 206/45.11; 206/45.14; 206/6.1; 312/248; 211/7; 248/222.3; 248/222.4

[58] Field of Search ..... 190/16, 17, 117; 206/45.11, 45.14, 6.1, 566, 495; 312/248, 251, 252; 211/13, 7; 248/222.4, 222.3

[56] References Cited

U.S. PATENT DOCUMENTS

| | | | |
|---|---|---|---|
| 1,241,615 | 10/1917 | Farrow | 312/251 X |
| 3,421,634 | 1/1969 | Huth | 211/13 X |
| 4,058,356 | 11/1977 | Michal | 206/566 X |
| 4,223,862 | 9/1980 | Doughty | 248/222.3 |
| 4,287,986 | 9/1981 | Beck | 206/45.19 |
| 4,324,446 | 4/1982 | Le Sage | 206/45.15 X |
| 4,406,372 | 9/1983 | Bell | 206/566 |
| 4,413,736 | 11/1983 | Nibling | 206/45.11 X |
| 4,420,084 | 12/1983 | Whelan | 206/45.11 X |
| 4,776,650 | 10/1988 | Feremzi | 211/13 X |
| 4,848,585 | 7/1989 | Snyder | 206/495 X |

FOREIGN PATENT DOCUMENTS

| | | | |
|---|---|---|---|
| 2069331 | 8/1981 | United Kingdom | 211/13 |

*Primary Examiner*—David T. Fidei
*Assistant Examiner*—Jacob K. Ackun, Jr.
*Attorney, Agent, or Firm*—Leon Gilden

[57] ABSTRACT

A jewelry closet including three relatively pivotally mounted sections is set forth wherein a first section includes a parallel series of removable ring support rods reciprocatably mounted in the first section with an overlying pivotally mounted earring support panel and an underlying resilient pin cushion. The second section includes a medially mounted plate with threadedly mounted hooks selectively positionable within the plate, both forwardly and rearwardly of the plate. The third section includes a further series of hooks threadedly received within a support plate wherein the support plate is oriented for securement to a horizontal support surface.

9 Claims, 3 Drawing Sheets

JEWELRY CLOSET

BACKGROUND OF THE INVENTION

1. Field of the Invention

The field of invention relates to jewelry support cases, and more particularly pertains to a new and improved jewelry closet wherein the same includes a series of relatively securable and pivotally mounted sections for securement of various types of jewelry within the sections.

2. Description of the Prior Art

The use of storage cabinets for jewelry and the like is well known in the prior art. As may be appreciated, these devices have typically required a substantial amount of space or have been of relatively inconvenient organization in use. The instant invention attempts to overcome the prior art by providing a jewelry closet securable to a horizontal surface. Attempts to develop jewelry closets of the prior art include U.S. Pat. No. 4,287,986 to Beck wherein a case-like organization is transportable and may be opened to a generally planar configuration to present the various items stored therein.

U.S. Pat. No. 4,324,446 to LeSage sets forth a jewelry case including a plurality of pivotally mounted wing-like compartments securable to a central panel. The wings are of generally half the width of the central panel to define an enclosed case when the wings are secured to the panel.

U.S. Pat. No. 4,371,077 to Solitt sets forth a jewelry display apparatus including a pivotally mounted reflective mirror nestable within a portion of the storage unit with the other portion of the storage unit arranged for securement of various jewelry items therewithin.

U.S. Pat. No. 4,413,716 to Nibling sets forth a jewelry box with an overlying cover and a plurality of panels within the cover to secure various jewelry items therewithin. The cover is mounted for securement of a picture therewithin, as the case underlying the cover is thereby hidden from view.

U.S. Pat. No. 4,420,084 to Whelan sets forth a jewelry cabinet including a plurality of sections wherein the sections are pivotally securable one to the other with a series of apertures for receiving jewelry items, such as earrings, through the apertures.

As such, it may be appreciated that there is a continuing need for a new and improved jewelry closet wherein the same addresses both the problems of providing storage of various jewelry categories within the apparatus and further is securable in enclosed configuration for compact storage of the jewelry during periods of non-use.

SUMMARY OF THE INVENTION

In view of the foregoing disadvantages inherent in the known types of jewelry containers now present in the prior art, the present invention provides a jewelry closet wherein the same provides a trio of jewelry storage compartments securable to a vertical support surface. As such, the general purpose of the present invention, which will be described subsequently in greater detail, is to provide a new and improved jewelry closet which has all the advantages of the prior art jewelry storage compartments and none of the disadvantages.

To attain this, the present invention comprises a jewelry closet including a first, second, and third section, each pivotally mounted relative to one another including latches for securement of the compartments relative to one another during periods of non-use. The first compartment includes a series of overlying jewelry support rods reciprocatably mounted within the first section for storage of rings thereon and interlocked within the compartment by means of a tab located on the rods insertable within a keyhole formed within the forward side wall of the first section. An overlying pivotally mounted jewelry storage panel and an underlying pin cushion arrangement is provided. The second section includes a medially mounted panel with selectively mounted hooks positioned within the panel to enable selective positioning of the hooks relative to the panel for securement of various types of jewelry therein. The third panel includes a further securement panel that is mountable to a vertical support surface and further is provided with additional selectively repositionable hooks thereabout. Each of the sections include an underlying containment wall for forming compartments at lowermost portions of each section.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jewelry closet which has all the advantages of the prior art jewelry containers and none of the disadvantages.

It is another object of the present invention to provide a new and improved jewelry closet which may be easily and efficiently manufactured and marketed.

It is a further object of the present invention to provide a new and improved jewelry closet which is of a durable and reliable construction.

An even further object of the present invention is to provide a new and improved jewelry closet which is susceptible of a low cost of manufacture with regard to both materials and labor, and which accordingly is then susceptible of low prices of sale to the consuming public, thereby making such jewelry closets economically available to the buying public.

Still yet another object of the present invention is to provide a new and improved jewelry closet which provides in the apparatuses and methods of the prior art some of the advantages thereof, while simultaneously overcoming some of the disadvantages normally associated therewith.

Still another object of the present invention is to provide a new and improved jewelry closet formed of three sections, each pivotally mounted relative to one another and securable relative to one another to provide a compact storage unit during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
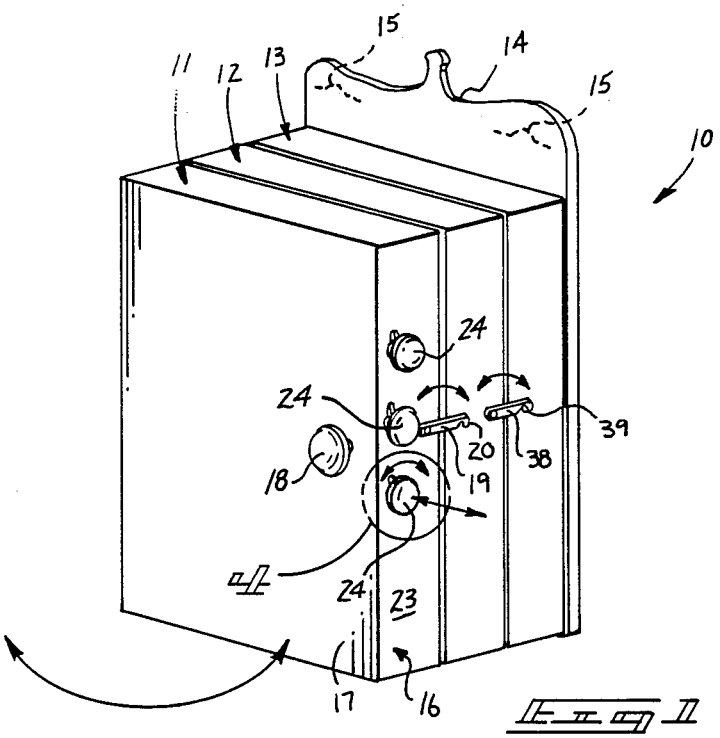
FIG. 1 is an isometric illustration of the instant invention.
Figure 2:
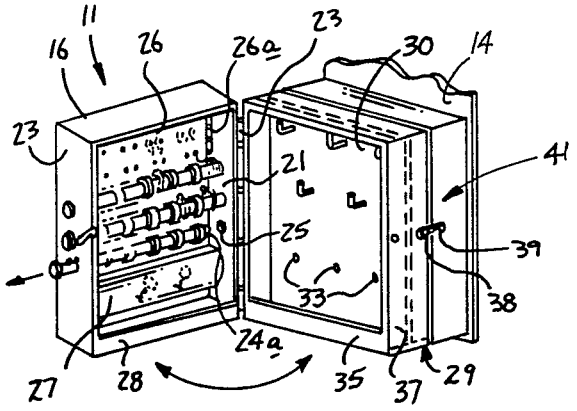
FIG. 2 is an isometric illustration of the instant invention with the first section pivotally mounted outwardly relative to the second and third sections.
Figure 3:
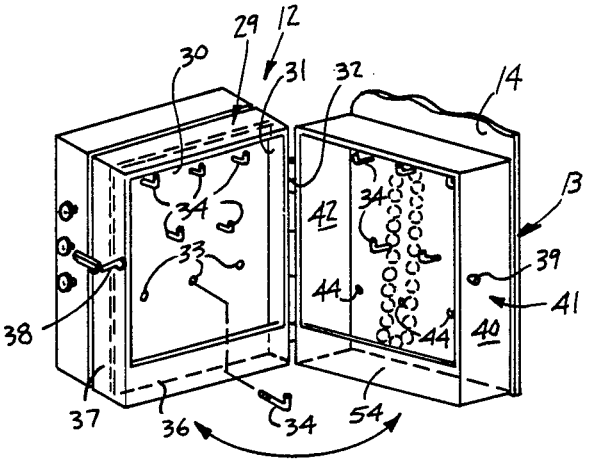
FIG. 3 is an isometric illustration of the instant invention with the first and second sections pivotally mounted outwardly relative to the third section.
Figure 4:
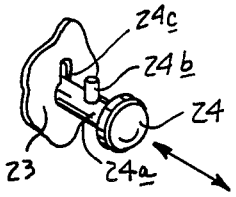
FIG. 4 is an isometric illustration of the securement mechanism of the ring post relative to the first section.
Figure 5:
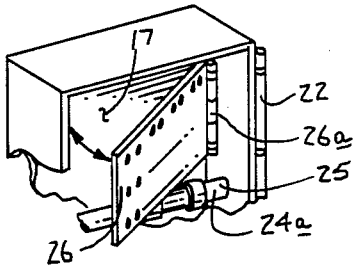
FIG. 5 is an isometric illustration of the earring support panel mounted relative to the first section.

With reference now to the drawings, and in particular to FIGS. 1 to 5 thereof, a new and improved jewelry closet embodying the principles and concepts of the present invention and generally designated by the reference numeral 10 will be described.

More specifically, it will be noted that the jewelry closet 10 essentially comprises a first section 11 pivotally mounted to a second section 12 wherein the second section 12 is pivotally mounted to a third section 13 that includes a rear support plate 14 that may include typical mounting hooks 15 on a rear surface thereof for securement to a vertical support surface, such as a wall.

The first section 11 includes a first rectangular frame 16 including a forward wall 17 formed at the outermost edges of the first frame 16. The forward wall 17 includes a grasp knob 18 extending orthogonally outwardly thereof. A first pivot latch 19 is pivotally mounted to a forward side wall 23 of the first rectangular frame 16 and is latchable to a first pivot pin 20 that is mounted to a forward side wall 37 of the second section 12. The rear side wall 21 of the first rectangular frame 16 has mounted thereto a first elongate hinge 22 extending substantially coextensively with a forward edge of the rear side wall 21 and a rear edge of the rear side wall 31 of the second section 12.

Extending orthogonally and slidingly through the forward side wall 23 are a series of three ring posts 24, each including an enlarged head extending exteriorly of the side wall 23, with an elongate body **24*a*, each extending through the interior of the first section 11 and received within securement apertures 25 formed through the rear side wall 21 to maintain the ring post 24 in parallel relationship relative to one another. Each of the ring post bodies include an orthogonally and outwardly extending projection 24*b* positioned adjacent the enlarged head of each ring post received within a keyhole aperture 24*c* formed within the forward side wall 23 wherein the ring post 24 must be first rotated relative to the side wall 23 and then reciprocatably withdrawn relative to the side wall 23 to remove the ring post and enable access to each of the rings that are mounted upon the ring post body 24*a***.

Pivotally mounted above the ring post 24 is an earring support panel 26 formed with plural pairs of apertures therethrough for receiving earring posts therethrough. The support panel 26 is formed with a support panel hinge **26*a* formed adjacent the forward wall 17 adjacent the forward edge of the rear side wall 21 to enable the earring support panel 26 to be pivoted outwardly relative to the interior of the first section 11 to enable access to the various pairs of earrings that may be positioned through the apertures formed within the panel 26. Positioned underlying the series of ring posts 24 is a resilient cushion 27 to receive various stick pins therewithin for storage of such pins in a safe and readily accessable orientation relative to the first section 11. The first section 11 further includes a first section rear containment wall 28 of a height substantially equal to a spacing between the resilient cushion 27 and the floor of the first rectangular frame 16** to define a first compartment therein and enable containment of various unsecured portions of jewelry for storage.

The second section 12 includes a second perimeter framework 29 with a second section panel 30 of equal cross-sectional configuration to the interior of the rectangular framework 29 fixedly mounted medially of the framework 29. The second rectangular framework 29 includes a second elongate hinge 32 substantially coextensive with the second section rear side wall 31 and mounted to a rear edge of the side wall 31 and to a forward edge of the third section rear side wall 42. The second section panel 30 includes a matrix of second section threaded bores 33 to receive "L" shaped hooks 34 formed with elongate threaded legs for threaded reception within the threaded bores 33. The second section forward wall 35 is mounted to forward edges of the floor and lowermost portions of the second rectangular framework 29 to define a second compartment between the forward wall 35 and a forward face of the second section panel 30. A second section rear wall 36 extends upwardly from the floor and is secured to the lowermost portions of the rear edges of the framework 29 to define a third compartment positioned between a rear face of the second section panel 30 and the wall 36. Pivotally mounted to the forward wall 37 of the second section is a second pivot latch 38 cooperating with a second pivot pin 39 extending orthogonally outwardly from the forward side wall 40 of the third rectangular framework 41 of the third section 13. The third section 13 further includes the support plate 14 secured to the rear edges of the third rectangular framework 41. Further, the forward face of the support plate 14 defined within the perimeter of the third rectangular framework 41 includes third section threaded bores 44 to receive "L" shaped hooks 34 therewithin. In the second and third sections 12 and 13 respectively and more specifically within the second section panel 30 and the support plate 14, there are defined a matrix of the aforenoted threaded bores 33 and 44 of a number to exceed the number of the "L" shaped hooks 34 to enable repositioning of the hooks 34, as desired, for securement of various bracelets, pendants, necklaces, and the like of various lengths and therefore requires the repositioning ability of the hooks 34 within various portions of the panel 30 and the support plate 14, as noted. A forward wall 54 is secured to forward edges of the floor of the third rectangular framework 41 and to lowermost edge portions of the rear and forward side walls 42 and 40 respectively to define a third section compartment at a lowermost portion of the third section 13.

Accordingly, when an individual has positioned jewelry as desired within the first, second, and third sections of the jewelry closet 10, the jewelry closet is pivotally closed to an orientation, as illustrated in FIG. 1, wherein the first and second pivot latches 19 and 38 are secured to the respective first and second pivot pins 20 and 39 to provide a secure and enclosed jewelry closet, as illustrated. It should be further understood that the first rectangular framework 16, the second rectangular framework 29, and the third rectangular framework 41 are of equal geometric configurations to enable secure confinement of the interior of the jewelry closet 10 when in an enclosed orientation.

Figure 6:
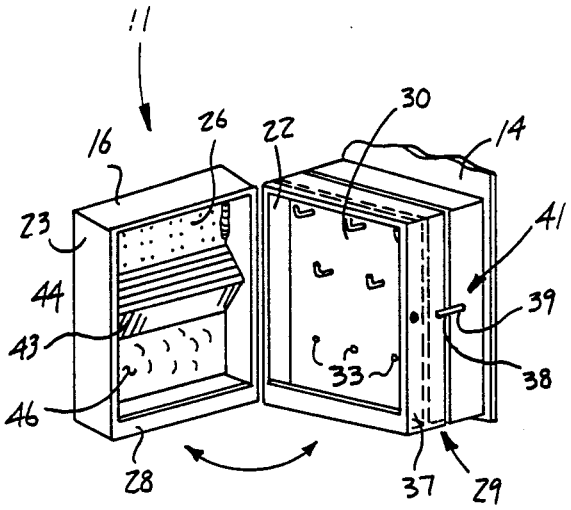
FIG. 6 is an isometric illustration of a further embodiment of the instant invention open to illustrate the first and second sections.

The embodiment illustrating first section 11*a* set forth in FIG. 6 notes the use of a ring cabinet 43 of a triangular prismoidal configuration formed with cushioned and fabric covered ring receiving slots 44 coextensively and traversely formed about an upper surface of the ring cabinet 43 and of a depth to receive a series of rings therein for storage. It is contemplated at least four such slots 44 be utilized. A pin cushion area 46 is provided underlying the ring cabinet 43 for reception and storage of various pins, broaches, and the like.

Figure 7:
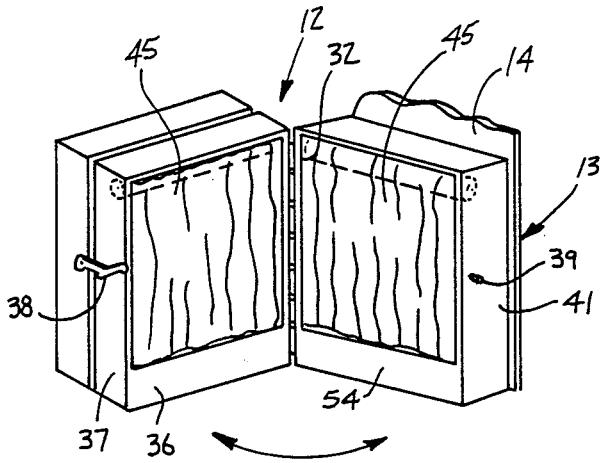
FIG. 7 is an isometric illustration of the further embodiment of the instant invention open to illustrate its second and third sections in combination with curtain members.

FIG. 7 notes the use of debris shielding curtains 45 secured to upper interior cavity portions of the second section 12*a* and the third section 13*a* to assist in the separation and integrity of jewelry items contained within the respective sections. In use the curtains are merely draped over and descend from respective upper surfaces of each respective sections. To gain access to interior portions of the sections, the curtains are merely manually repositioned by a user. invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jewelry closet comprising, a first section, a second section, and a third section with said first section pivotally mounted to said second section, and said second section pivotally mounted to said third section, and said third section fixedly mounted to a support plate, and said support plate including fastening means mounted onto a rear surface of said support plate for securement to a vertical support surface;

said first section defined by a first rectangular framework, said second section defined by a second rectangular framework, and said third section defined by a third rectangular framework, and said first, said second, and said third rectangular frameworks each formed of equal geometric rectangular configuration and wherein said first rectangular framework includes a forward wall parallel to and spaced from a rear wall with a plurality of posts wherein each post includes an enlarged head extending outwardly of the forward wall and extending interiorly of the first rectangular framework and wherein each post is received within an aperture formed within the rear wall, and each post includes an outwardly extenidng projection adjacent the enlarged head and wherein the projection is received within a keyhole aperture formed within the forward wall.

2. A jewelry closet as set forth in claim 1 wherein the first rectangular framework further includes a support panel, and the support panels is pivotally mounted adjacent a forward edge of the rear wall of the first rectangular framework, and the support panel includes plural pairs of apertures therethrough for receiving portions of earring jewelry.

3. A jewelry closet as set forth in claim 2 wherein the first rectangular framework further includes a resilient cushion means for receiving pins therein in underlying orientation relative to the posts.

4. A jewelry closet as set forth in claim 3 wherein the pivotal mounting of the first section to the second section comprises a first elongate hinge formed substantially coextensively with a rear edge of the first rectangular section and secured to a forward edge of a rear wall of the second rectangular section.

5. A jewelry closet as set forth in claim 4 wherein the first section further includes a connecting wall overlying forward edges of the first rectangular section, and the connection wall includes a grasp knob extending orthogonally outwardly of the connecting wall.

6. A jewelry closet as set forth in claim 5 wherein the second section includes a second section panel, the second section panel of a configuration substantially equal to that defined by the interior of the second rectangular framework, and the second section panel integrally and fixedly secured medially of the second rectangular framework, and the second section panel including a matrix of threaded apertures, and a plurality of "L" shaped hooks formed with threaded ends for threaded reception within the threaded apertures.

7. A jewelry closet as set forth in claim 6 wherein the second rectangular framework includes a second elongate hinge substantially coextensively formed to a rear edge of the rear wall of the second rectangular framework and wherein the second hinge is secured to a rear wall of the third rectangular framework to pivotally mount the second section relative to the third section.

8. A jewelry closet as set forth in claim 7 wherein the third rectangular section includes the support plate fixedly mounted to rear edges of the third rectangular framework, and the support plate extends beyond the third rectangular framework, and a forward surface of the support plate within the third rectangular framework includes a further matrix of threaded apertures for receiving a further plurality of "L" shaped hooks formed with threaded reception within the further threaded apertures.

9. A jewelry closet as set forth in claim 8 wherein the first rectangular framework includes a first pivoted latch pivotally mounted to the first rectangular framework and securable to a pin integrally secured to a second rectangular framework, and the second rectangular framework further includes a second pivoted latch pivotally mounted to the second rectangular framework and securable to a further pin mounted to the third rectangular framework.

* * * * *